US008960450B2

(12) United States Patent
Caffell et al.

(10) Patent No.: US 8,960,450 B2
(45) Date of Patent: Feb. 24, 2015

(54) APPARATUS AND METHOD FOR IMPLEMENTING HYDROCLONE BASED FLUID FILTRATION SYSTEMS WITH EXTENSIBLE ISOLATED FILTER STAGES

(75) Inventors: George D. Caffell, Moss Beach, CA (US); Steven E. O'Reilly, Menlo Park, CA (US); John H. Mallard, Saratoga, CA (US)

(73) Assignee: Dow Global Technologies LLC, Midland, MI (US)

( * ) Notice: Subject to any disclaimer, the term of this patent is extended or adjusted under 35 U.S.C. 154(b) by 701 days.

(21) Appl. No.: 13/314,967

(22) Filed: Dec. 8, 2011

(65) Prior Publication Data

US 2012/0145609 A1 Jun. 14, 2012

Related U.S. Application Data

(60) Provisional application No. 61/421,095, filed on Dec. 8, 2010.

(51) Int. Cl.
*B04C 5/22* (2006.01)
*B04C 9/00* (2006.01)

(52) U.S. Cl.
CPC ... *B04C 9/00* (2013.01); *B04C 5/22* (2013.01); *B04C 2009/004* (2013.01)
USPC ..... 210/512.1; 210/304; 210/305; 210/355; 210/314; 210/107

(58) Field of Classification Search
CPC ..... B04C 5/08; B04C 5/081; B04C 5/103; B04C 5/13; B04C 5/136; B04C 5/12; B04C 5/22; B04C 2005/136; B04C 2009/004; B04C 9/00; B04C 11/00; B01D 17/0217; B01D 17/04; B01D 17/08; B01D 19/0094; B01D 19/0057; B01D 21/26; B01D 21/265; B01D 21/267; B01D 36/045
USPC ..... 210/304, 305, 512.1, 788, 787, 791, 210/323.1, 323.2, 332, 338, 354, 355, 413, 210/428, 512.3, 257.2, 314, 107
See application file for complete search history.

(56) References Cited

U.S. PATENT DOCUMENTS 431,448 A 7/1890 Dixon
1,107,485 A 8/1914 Bowser
(Continued)

FOREIGN PATENT DOCUMENTS

DE 4420730 5/1995
DE 4420760 5/1995
(Continued)

OTHER PUBLICATIONS

DOW Water & Process Solutions, G. Onifer, Oct. 2010, Executive Summary: Clean Filtration Technologies, Inc Turboclone Filter, 3 Pages.
(Continued)

*Primary Examiner* — David C Mellon
(74) *Attorney, Agent, or Firm* — Edward W. Black

(57) ABSTRACT

Filter assemblies and fluid flow inhibitors that are particularly well suited for use in centrifugal separation enhanced filtration devices are described. Moreover extensible filter assemblies are described. In one aspect of the invention, extensible filtration assemblies can be used to operate in circulating fluid filtration devices. Such extensible filter elements can use fluid manifold to reduce the effects of fluid circulation inside filter elements and to reduce reverse flow problems in such filters. Additionally, indexable filter elements and invertable filtration elements can be used to extend filter life in filtration in filtration devices.

15 Claims, 13 Drawing Sheets

(56) References Cited

U.S. PATENT DOCUMENTS

| | | | |
|---|---|---|---|
| 1,919,653 | A | 7/1933 | Hill |
| 2,706,045 | A | 4/1955 | Large |
| 2,788,087 | A | 4/1957 | Lenehan |
| 2,917,173 | A | 12/1959 | Rakowsky |
| 3,061,098 | A | 10/1962 | Brezinski |
| 3,219,186 | A | 11/1965 | Polhemus et al. |
| 3,285,422 | A | 11/1966 | Wiley |
| 3,529,724 | A | 9/1970 | Maciula et al. |
| 3,822,533 | A | 7/1974 | Oranje |
| 3,893,914 | A | 7/1975 | Bobo |
| 3,947,364 | A | 3/1976 | Laval, Jr. |
| 4,062,766 | A | 12/1977 | Duesling |
| 4,120,783 | A | 10/1978 | Baummer |
| 4,146,468 | A | 3/1979 | Wilson |
| 4,159,073 | A | 6/1979 | Liller |
| 4,178,258 | A | 12/1979 | Papay et al. |
| 4,216,095 | A | 8/1980 | Ruff |
| 4,298,465 | A | 11/1981 | Druffel |
| 4,414,112 | A | 11/1983 | Simpson et al. |
| 4,575,406 | A | 3/1986 | Slafer |
| 4,596,586 | A | 6/1986 | Davies et al. |
| 4,608,169 | A | 8/1986 | Arvanitakis |
| 4,654,540 | A | 3/1987 | Bridges |
| 4,662,909 | A | 5/1987 | Durr |
| 4,698,156 | A | 10/1987 | Bumpers |
| 4,865,751 | A | 9/1989 | Smisson |
| 4,931,180 | A | 6/1990 | Darchambeau |
| 5,104,520 | A | 4/1992 | Maronde et al. |
| 5,116,516 | A | 5/1992 | Smisson |
| 5,188,238 | A | 2/1993 | Smisson et al. |
| 5,227,061 | A | 7/1993 | Bedsole |
| 5,277,705 | A | 1/1994 | Anderson et al. |
| 5,407,584 | A | 4/1995 | Broussard, Sr. |
| 5,466,384 | A | 11/1995 | Prevost et al. |
| 5,478,484 | A | 12/1995 | Michaluk |
| 5,593,043 | A | 1/1997 | Ozmerih |
| 5,879,545 | A | 3/1999 | Antoun |
| 5,972,215 | A | 10/1999 | Kammel |
| 6,110,242 | A | 8/2000 | Young |
| 6,117,340 | A | 9/2000 | Carstens |
| 6,210,457 | B1 | 4/2001 | Siemers |
| 6,238,579 | B1 | 5/2001 | Paxton et al. |
| 6,251,296 | B1 | 6/2001 | Conrad et al. |
| 6,511,599 | B2 | 1/2003 | Jarpszczyk et al. |
| 6,531,066 | B1 | 3/2003 | Saunders et al. |
| 6,613,231 | B1 | 9/2003 | Jitariouk |
| 6,790,346 | B2 | 9/2004 | Caleffi |
| 6,896,720 | B1 | 5/2005 | Arnold et al. |
| 7,166,230 | B2 | 1/2007 | Nilsen et al. |
| 7,316,067 | B2 | 1/2008 | Blakey |
| 7,351,269 | B2 | 4/2008 | Yau |
| 7,632,416 | B2 | 12/2009 | Levitt |
| 7,651,000 | B2 | 1/2010 | Knol |
| 7,785,479 | B1 | 8/2010 | Hosford |
| 7,854,779 | B2 | 12/2010 | Oh |
| 7,896,169 | B2 | 3/2011 | Levitt et al. |
| 7,998,251 | B2 | 8/2011 | Pondelick et al. |
| 8,201,697 | B2 | 6/2012 | Levitt et al. |
| 8,663,472 | B1 | 3/2014 | Mallard et al. |
| 8,701,896 | B2 | 4/2014 | Levitt et al. |
| 8,882,999 | B2 | 11/2014 | Levitt et al. |
| 2003/0029790 | A1 | 2/2003 | Templeton |
| 2003/0221996 | A1 | 12/2003 | Svoronos et al. |
| 2004/0211734 | A1 | 10/2004 | Moya |
| 2005/0109684 | A1 | 5/2005 | DiBella et al. |
| 2007/0039900 | A1 | 2/2007 | Levitt |
| 2007/0045168 | A1 | 3/2007 | Levitt et al. |
| 2007/0075001 | A1 | 4/2007 | Knol |
| 2007/0187328 | A1 | 8/2007 | Gordon |
| 2010/0044309 | A1 | 2/2010 | Lee |
| 2010/0083832 | A1 | 4/2010 | Pondelick et al. |
| 2010/0096310 | A1 | 4/2010 | Yoshida |
| 2011/0160087 | A1 | 6/2011 | Zhao et al. |
| 2011/0220586 | A1 | 9/2011 | Levitt |
| 2012/0010063 | A1 | 1/2012 | Levitt et al. |
| 2012/0145609 | A1 | 6/2012 | Caffell et al. |
| 2013/0126421 | A1 | 5/2013 | Levitt et al. |

FOREIGN PATENT DOCUMENTS

| | | |
|---|---|---|
| DE | 19914674 | 12/2000 |
| DE | 10001737 | 10/2001 |
| DE | 102005027509 | 12/2006 |
| EP | 0375671 | 6/1990 |
| EP | 0475252 | 3/1992 |
| EP | 0380817 | 1/1993 |
| EP | 0566792 | 10/1993 |
| EP | 0429409 | 4/1994 |
| EP | 2082793 | 7/2009 |
| FR | 2791904 | 10/2000 |
| GB | 2007118 | 5/1979 |
| GB | 2309182 | 7/1997 |
| GB | 2423264 | 8/2006 |
| KR | 100511328 | 8/2005 |
| KR | 10-0899416 | 5/2009 |
| WO | 0218056 | 3/2002 |
| WO | 03026832 | 4/2003 |
| WO | 2004064978 | 8/2004 |
| WO | 2011160087 | 12/2011 |
| WO | 2012078925 | 6/2012 |
| WO | 2012154448 | 11/2012 |
| WO | 2013181028 | 12/2013 |
| WO | 2013181029 | 12/2013 |

OTHER PUBLICATIONS

Clean Filtration Technologies, Inc. CFT Turboclone Demo System, 2010.

Clean Filtration Technologies, Inc. CFT Turboclone TC-201 Technical Datasheet, 2010.

APPARATUS AND METHOD FOR IMPLEMENTING HYDROCLONE BASED FLUID FILTRATION SYSTEMS WITH EXTENSIBLE ISOLATED FILTER STAGES

CROSS REFERENCE TO RELATED APPLICATIONS

This application claims priority of U.S. Provisional Patent Application No. 61/421,095 filed Dec. 8, 2010, which is incorporated herein by reference in its entirety.

FIELD OF THE INVENTION

The present invention generally relates to hydroclone filter cleaning assemblies and chamber manifolds for use in centrifugal separation enhanced filtration. In one aspect, extensible filter assemblies are discussed. The described devices may be used in a variety of water treatment, fluid filtering and particle separation applications.

BACKGROUND OF THE INVENTION

The present invention generally relates to hydroclone filter systems, methods and apparatus. The described devices may be used in a variety of water treatment, fluid filtering and particle separation applications.

A wide range of technologies are currently used to treat, purify and/or filter water. Many such technologies require a relatively large amount of physical space and/or require the use of consumable filters that add to operational costs. For example, many drinking water treatment applications utilize settling ponds in combination with a series of screens and filters of progressively decreasing pore size to remove suspended solid particles from water.

In other applications cyclonic separators or hydroclones have been used to separate suspended particles from water and other fluid mediums. Hydroclones operate by introducing water into a conically shaped chamber to create a vortex within the chamber. Generally, the influent water is introduced near the top of a conical chamber and an effluent stream is discharged near the bottom of the chamber. Centrifugal force tends to cause heavier particles to move towards the periphery of the vortex. As a result the water near the center of the vortex tends to be cleaner than water at the periphery of the vortex. Thus, relatively cleaner water can be drawn from a central region of the hydroclone. By way of example, U.S. Pat. Nos. 3,529,724; 5,407,584, 5,478,484, and 5,879,545 all describe various hydroclone designs.

Although hydroclones have been used to remove suspended particles from water in a variety of applications, existing hydroclones are generally not well suited for filtering applications that require the removal of relatively small sized particles from large volumes of water. Therefore, hydroclones are typically not used to pre-filter drinking water or in a wide variety of other applications due to limitations in their filtering ability.

Although existing water filtering systems and existing hydroclones work well for their intended uses, there are continuing efforts to provide improved and/or more cost effective purification and/or filtering devices that can meet the needs of various specific applications.

SUMMARY OF THE INVENTION

Filter assemblies that are flexible in use and adaptable to a wide range of contamination environments are desirable and well suited to aspects of centrifugal separation enhanced filtration devices which are described as follows.

In one aspect of the invention, a centrifugal separation enhanced filtration device is described. Such devices include a hydroclone tank having a number of fluid inlets and outlets that provide an inlet for fluid requiring filtration, a filtered fluid outlet arranged to extract filtered fluid from a filter assembly, an effluent outlet and an internal chamber having arranged to enable a circulating fluid. The device also includes a cleaning assembly that rotates around the filter to assist cleaning of the filter. In one particularly advantageous implementation, the device further includes a plurality of filter stages including a first and supplementary stage arranged such that the filtered fluid outlet can extract filtered fluid from the filtered fluid chamber of the first stage. Moreover, the staged filter is arranged such that each supplementary stage is in communication with the filtered fluid chamber of the first stage but not with other supplementary stages.

In one aspect, the supplementary stages include associated manifolds that prevent direct fluid circulation from a supplementary stage to an adjacent stage comprises a connector enabling filtered fluid communication between the first stage and the filtered fluid chamber of each supplementary stage.

In another aspect, the filter assembly comprises an extensible filter assembly that can be adjusted in its filter capacity. Additional stages can be added to the assembly or stages can be removed at need. Thus, the staged filter assembly comprises an extensible filter assembly configured to enable additional supplementary filter stages to be added or removed from the staged filter assembly. It is pointed out that each of these added stages can include manifolds to control fluid flow in the system.

In another aspect, centrifugal separation enhanced filtration devices comprise pressure management systems used to balance and/or optimize pressure in the filtration device to enhance filter efficiency.

In another aspect, centrifugal separation enhanced filtration devices comprise rotation control systems that manage the rotation rate of the rotating cleaning assembly to adjust rotation rate to optimize filtration and/or cleaning performance.

In another aspect, centrifugal separation enhanced filtration devices systems and filter assemblies comprise flexible and reorientable filter assemblies that can enable reduced filter wear by rotation and readjustment of filter orientation are also disclosed in the patent.

In another aspect a staged filter assembly is disclosed. The assembly can include a plurality of filter stages including a first stage and at least one supplementary stage. Each filter stage can include a frame element and an associated filter membrane defining therein a filtered fluid chamber. The assembly configured such that the filter stages are stacked concentrically one upon another. And such that each supplementary stage is in fluid communication with the first stage and configured such that fluid from one supplementary stage cannot communicate with fluid from another supplementary stage. In one aspect, this can be facilitated using manifolds associated with the stages. Such that a manifold prevents direct fluid circulation from a supplementary stage to an adjacent stage. In one approach, a manifold comprises a connector enabling filtered fluid communication between the filtered fluid chamber of the first stage and the filtered fluid chamber of each supplementary stage. Additionally an isolation member can work cooperatively with a connector to enable the inhibition of direct chamber to chamber filtered fluid flow while enabling filtered fluid flow from all chambers to the filtered fluid chamber of the first stage.

In another aspect, such filter assemblies are extensible as needed, by adding or removing supplementary filter stages with or without associated manifolds.

The described filtration devices and filter assemblies are particularly well suited for use in operating centrifugal separation enhanced filtration devices including hydroclone filtration devices, cylindrical centrifugal enhanced filtration device, and other cross-flow filtration applications.

BRIEF DESCRIPTION OF THE DRAWINGS

The invention, together with further objects and advantages thereof, may best be understood by reference to the following description taken in conjunction with the accompanying drawings in which:

FIG. 4(*b*) is a diagrammatic cross-section view of an embodiment of a cleaning assembly paddle and cleaning element arranged in an operative arrangement with a filter element in accordance with an aspect of the present invention;

FIG. 4(*c*) is a diagrammatic plan view of a fluid bearing suitable for supporting a cleaning assembly as it is rotated about a filter assembly in accordance with an embodiment of the present invention;

FIG. 5(*b*) is a top down view of the nested filter assembly and cleaning assembly showing how a vortex flow can rotate the cleaning assembly around a filter assembly in one embodiment of the hydroclone;

FIG. 5(*c*) is a top down view of a portion of a cleaning assembly and one embodiment of an associated particulate tolerant fluid bearing illustrating an angled orientation for the paddles and magnetic marker;

FIGS. 5(*d*)-5(*e*) are diagrammatic side section views of filter and associated rotating cleaning assemblies illustrating certain types of uneven wear patterns that can occur in some embodiments of the invention;

FIGS. 6(*b*)-6(*d*) are various diagrammatic top views illustrating various wear patterns and the effect of filter rotation to compensate for the wear in accordance with some embodiments of the invention;

FIG. 7(*b*) is an exploded view of the hydroclone embodiment shown in FIG. 7(*a*);

FIG. 7(*c*) is a simplified top down view of the hydroclone embodiment with manifold in an operative arrangement such as shown in FIG. 7(*a*); and FIG. 7(*d*) is a diagrammatic side section view of a filter frame and bottom portion showing an embodiment of an engagement feature of a hydroclone embodiment in accordance with the principles of the present invention.

The depictions in the figures are diagrammatic and not to scale. Additionally, the drawings depicted are illustrative examples and are not intended to limit the invention.

DETAILED DESCRIPTION OF THE PREFERRED EMBODIMENTS

The present invention generally relates to fluid filtration systems and to mechanisms for improving the filtration of such systems. A variety of methods and systems for providing extensible filter systems and filter cleaning approaches are also described. Also, extensible filter elements are described that can be added to and staged within a hydroclone chamber.

The assignee of the present invention has developed a hydroclone filter system that is well adapted for a wide variety of liquid filtering and particle separation applications. Various aspects and modifications of such a system are described in some detail in U.S. Pat. Nos. 7,632,416, 7,896,169 and U.S. Pat. No. 8,663,472 and U.S. Pat. No. 8,882,999, each of which are incorporated herein by reference.

General Explanation of Hydroclone Operation

Figure 1:
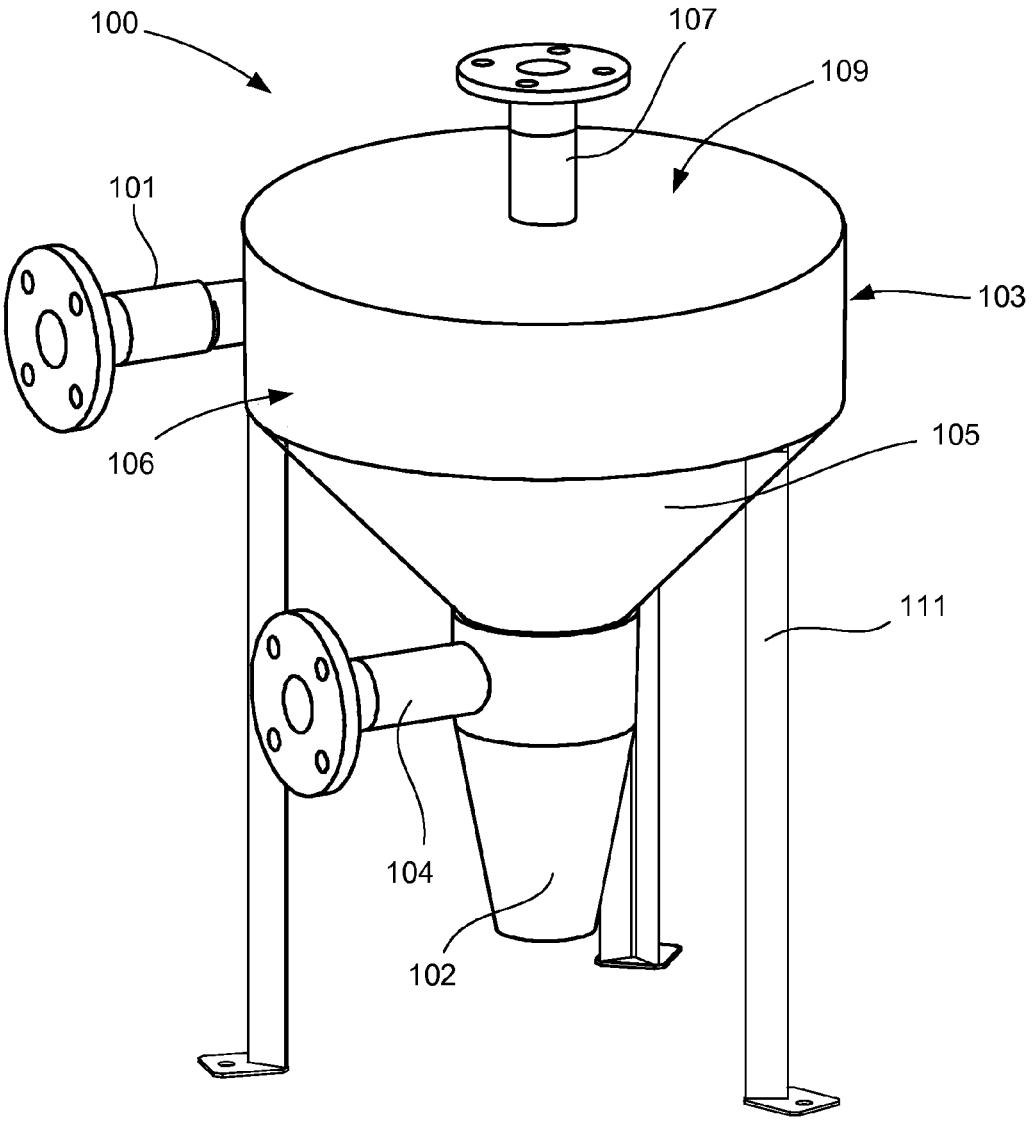
FIG. 1 is a diagrammatic external perspective view of a closed hydroclone based filtering system in accordance with an embodiment of the invention.
Figure 2:
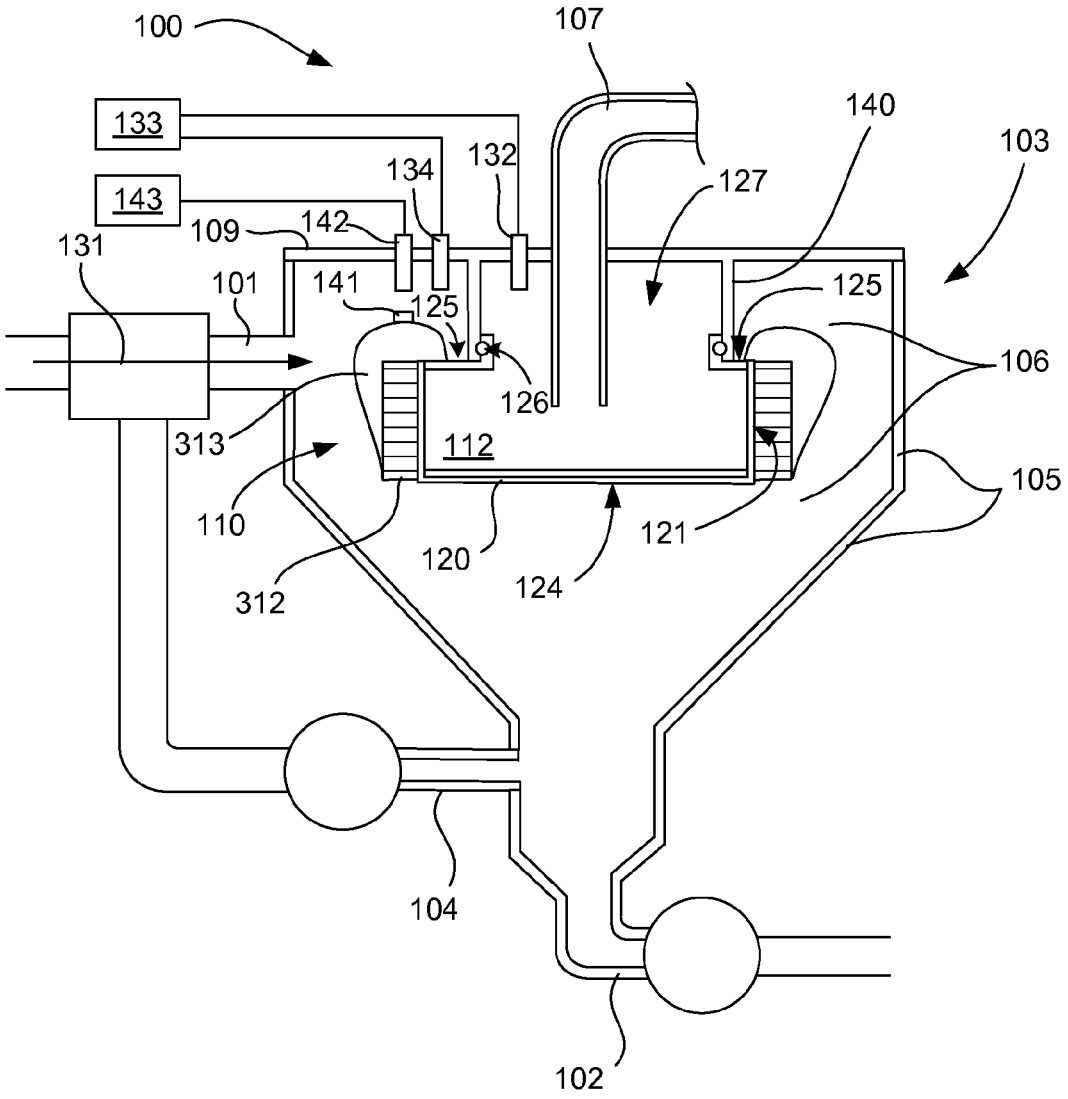
FIG. 2 is a diagrammatic cross-section view of a closed hydroclone based filtering system in accordance with an embodiment of the invention.
Figure 3:
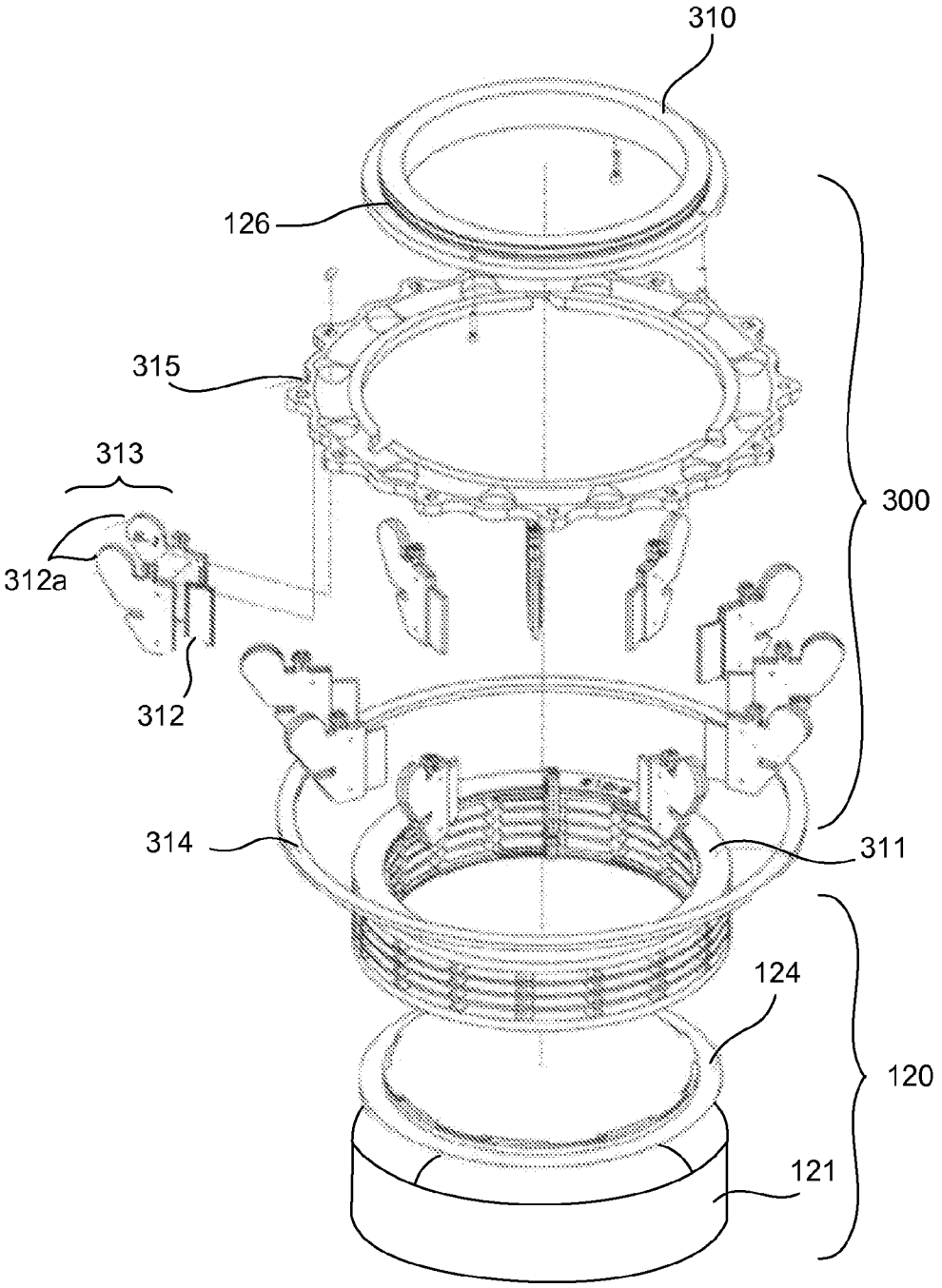
FIG. 3 is an exploded view of an example filter assembly and an associated cleaning assembly separated into conveniently described components in accordance with an embodiment of the invention.

Hydroclone based filtration systems in accordance with selected embodiments of the present invention are diagrammatically illustrated in FIGS. 1-3. As seen in FIG. 1, the hydroclone based filtration system 100 includes a housing 103 having chamber walls 105 and a lid 109. The chamber walls 105 define a tapered (frusto-conically shaped) fluid compartment 106 with the lid 109 arranged to cover the fluid compartment 106. The housing 103 can be supported by a stand 111 that can take any suitable form. In some embodiments, the hydroclone may not require a stand at all.

A filter assembly 120 is positioned within the fluid compartment 106. The filter assembly 120 (also referred to herein as "filter element") generally comprising a cross flow filtration membrane although not limited to such. In the embodiment illustrated in FIG. 2, the filter element has a substantially cylindrical shape. However, in other embodiments, the filter may incorporate any of a variety of geometries. By way of example, the filter element may be generally conical, frusto-conical, stepped, cylindrical, or any of a variety of other suitable shapes. The filter assembly is positioned centrally within the fluid compartment 106 so that the filter is spaced apart from the peripheral chamber walls 105. The region between the chamber walls 105 and the filter element is defined as a hydroclone chamber 110 and the region in the central region of the filter is defined as a filtered fluid chamber 112.

The filter assembly 120 includes a surface filter membrane 121 configured to serve as a cross-flow surface filter. The filter membrane 121 may take the form of a micro-filter having a multiplicity of fine elongate filtration apertures suitable for filtering very minute particulate from a fluid. One such filter element is discussed in more detail in the '416 patent (which is incorporated herein by reference).

The hydroclone 100 has four main openings. As shown here a fluid inlet 101 located at the wide (upper) end of the hydroclone chamber 110, an effluent outlet 102 located at the narrow (bottom) end of the hydroclone chamber 110, a reflow outlet 104 also located at a lower portion of the hydroclone chamber 110, reflow outlet 104 being configured to recirculate unfiltered fluid from the chamber 110 (e.g., unfiltered influent), and a filtered fluid outlet 107 arranged to remove filtered fluid from filtered fluid chamber 112. In this embodiment, the filtered fluid outlet 107 is arranged near an upper end (commonly the lid 109) of the housing 103. The fluid inlet 101 is preferably arranged to impel a tangential flow to the incoming fluid 131. In one example (such as shown by inlet 101 of FIG. 1) an offset inlet 101 provides a suitable approach. Thus, fluid entering 131 the hydroclone chamber 110 flows substantially tangentially into a region at the wide (top) end of the fluid compartment 106 between the chamber wall 105 and the filter 120 and generally moves through the hydroclone chamber 110 in a swirling vortex towards a bottom portion of the chamber 110 such that it can drain into an outlet portion 102 of the hydroclone 100. This portion of the chamber 110 which defines a region where the circulating vortex of fluid is operative can also be referred to as a fluid circulating region. Some of the fluid entering the hydroclone chamber will pass through the filter assembly 120 into the filtered fluid chamber 112. Filtered fluid (e.g., clean water) exits the filtered fluid chamber through the filtered fluid outlet 107. Any fluid in the hydroclone that does not pass through the filter 120 exits the hydroclone chamber 110 through the effluent outlet 102 or the reflow outlet 104.

The filter assembly 120 includes a surface filter 121 that is designed to prevent the entry of particles into the filtered fluid chamber 112. In one implementation, the filter can comprise a cross-flow filtration membrane. To continue, a circulating fluid flow is arranged to flow tangentially across the filter surface to help prevent particulate matter from entering the internal filtered fluid chamber. Such tangential flow of the feed stream across the filter surface is referred to as cross flow filtration.

By way of general description, the filtering characteristics of the described system can be varied significantly by controlling, among other things, the relative flow rates of the effluent 102 and filtered fluid 107 outlets as well as differential pressures between chamber 110 and 112. Additionally, system efficiencies and the concentrating characteristics of the system can be varied significantly by recirculating at least some of the effluent stream back into the hydroclone (e.g., using reflow line 104) and by controlling the relative rates and nature of such feedback.

There are a number of aspects of the illustrated hydroclone that make it work particularly well for fluid filtration applications. Generally, the device creates a fluid vortex causing heavier particles to migrate towards the exterior of the vortex, while lighter materials (e.g. cleaner liquids) tend to move towards the center of the vortex. With this arrangement, an effluent outlet near the bottom of the separator can be used to remove the particles, while an outlet that draws from a central region of the separator can be used to remove a more particle free liquid. In this implementation of a hydroclone based separator, the process is enhanced by using a filter assembly 120 to further separate the particles and other contaminants from the center region 112 of the hydroclone. Thus, the introduction of a central filter can be quite effective at improving the cleanliness of the discharged clean water.

A wide variety of filters 120 can be used within the hydroclone and their physical size, geometry and pore size may all be widely varied. Although a wide variety of different filter designs may be used within the hydroclone a few specific filter designs that are particularly well adapted for use in the hydroclone are briefly described below.

Generally, it is preferable to use a surface filter that blocks particles at the surface of the filter rather than a standard depth filter that collects particulates within the filter itself. As will be described in more detail below, the use of a surface filter facilitates self-cleaning and thus reduces the overall maintenance of the device since the surface filters do not need to be replaced as frequently as depth filters would typically need to be replaced. Such a surface filter can comprise many types. However, in one embodiment a surface filter comprises a plurality of elongate apertures. In a particular embodiment the elongate filter apertures are arranged such that a long axis of the apertures is vertically arranged. Thus, the narrow dimension of the apertures extends horizontally thus the tangential inflowing fluid 131 flows perpendicular to the long axis of the apertures. It is also possible that the pattern of apertures is slanted instead of vertical. By way of example, electroformed surface filters work well. Aperture dimensions can be widely varied. Embodiments having openings in the range of about 1-500 microns have been found to work well in a number of applications. For example, elongated (slot-like) apertures having a surface width in the range of 5 to 50 microns and a length in the range of 100 to 500 microns tend to work well. In one specific application, slots having a width of about 20 microns and a length of about 400 micron are used. Of course, these particular dimensions can be widely varied to meet the filtering requirements of any particular application. By way of example, some specific electroformed filter membranes that are well suited for use in hydroclone applications are described in the '416 patent. As will be appreciated by those of familiar with the art, other configurations and dimensions can be used as well. It is important to point out that the invention is not limited by type or capabilities of filtration elements or membranes.

The Filter Assembly

FIG. 2 is a cross sectional view of a hydroclone cleaning apparatus constructed in accordance with one embodiment of the invention. In particular, the cleaning apparatus includes a single stage cylindrical filter assembly 120. Further, FIG. 3 is an exploded view of a filter assembly 120 and an associated cleaning assembly 300 suitable for use within the hydroclone 100. The filter assembly 120 and cleaning systems are designed to be easily assembled and disassembled. Additionally, they are designed to be modular so that the filtering capacity of the hydroclone may readily be adjusted to meet the needs of any particular application.

The illustrated filter assembly 120 generally includes a surface filter membrane 121 that extends circumferentially around a frame 311. In some embodiments, a cylindrical surface filter membrane 121 is positioned about an outer surface of cylindrical frame 311 of the filter assembly 120 to form a cylindrical surface filter. Alternatively, a rectangular strip of filter material can be wrapped around the frame 311 and adhered or otherwise attached to form the filter. Additionally, a cylindrical filter membrane 121 can be arranged near an outer portion of the cylindrical frame 311 in any manner such that it provides a seal between the inner filter chamber and the outside of the filter assembly 120.

An end plate 124 is attached to one end (i.e., the bottom face) of the frame and an attachment ring 310 is secured to the other end of the frame. Thus, the bottom plate 124 seals the bottom of the frame 311. A seal 126 is provided on the upper surface of the attachment ring 310. In the one stage filter that is shown, the seal 126 engages with the lid 109 at the top surface 125 of the filter 120 to seal the top of the filter. An opening in the center of the attachment ring enables connection with the filtered fluid outlet 107.

Surface filters are arranged to block particulates contained in a feed stream at the surface of a filter membrane rather than trapping the particulates within a filter bed. During use, the filter pores will sometimes become blocked by particulates in the feed stream that are caught at the surface filter. The amount of blockage tends to increase the longer the filter is used so that over time, the filter throughput tends to degrade. Therefore, it is typically necessary to at least periodically clean the surface filter.

During operation of the hydroclone filter, the filter pores will sometimes become blocked by particulates in the feed stream within the hydroclone. U.S. Pat. No. 7,632,416 (which is incorporated herein by reference) describes the use of a circulating cleaning assembly positioned within the hydroclone region to help continually clean the exterior (feed side) surface of the filter membrane during operation of the hydroclone. The circulating cleaning assembly has been found to be very useful in extending the operational span of the filter before the filter becomes blocked. The described embodiments also incorporate a circulating cleaning assembly 300.

In the illustrated embodiments, the cleaning unit is integrated with the filter assembly such that the combined filter assembly/cleaning assembly can readily be inserted into and removed from the fluid chamber 106 as a single unit. In other embodiments, the components can be installed separately. The combined assembly 120/300 can be mounted on the lid 109 such that the whole filter unit is inserted into and removed from the fluid chamber 106 as a single unit with the opening and closing of the lid 109. One such arrangement is illustrated in FIG. 2. Preferably, the filter assembly is sealed relative to the lid 109 so that fluid within the hydroclone chamber 110 can not enter the filtered fluid chamber 112 without passing through the filter membrane. In one approach an upper support surface of the filter assembly has a seal 126 configured to engage with a mated portion of the lid 109. Thus, fluid cannot flow into chamber 112 unless it flows through the filter assembly 120 first.

Integration of Cleaning Structure with Filter Element

In the embodiment illustrated in FIG. 3, the cleaning assembly 300 comprises a generally circular structure encompassing a robust bearing support 315, a plurality of cleaning structures 312, a plurality of paddles 313, and a support ring 314. The bearing comprises a substantially rigid particulate tolerant fluid bearing 315 that provides a robust cleaning assembly. In general, several cleaning structures and paddles 312/313 are supported by the bearing 315 and the support ring 314 to enable rotation of the cleaning assembly 300 around the filter 120 during use of the hydroclone. The paddles are arranged to extend out into the circular fluid flow path within the hydroclone chamber so that during use, the fluid vortex drives the cleaning assembly about the filter. Although a particular cleaning assembly is shown, it should be appreciated that a wide variety of different cleaning assembly and paddle structures can be employed in alternative embodiments. It is pointed out that this structure 300 is more ruggedly built than prior art technologies providing more a tight fit and improved alignment with an associated journal surface or race such a the prior art embodiments which have a more flexible counting configuration.

In one embodiment, the paddles 313 can be configured to support cleaning structures 312 such that a cleaning surface of the cleaning structure is in contact with or is positioned an operative distance from the filter 121. The operative distance is variable depending on the nature of the cleaning structure 312 (e.g., brushes, squeegees, and other such surface cleaning apparatus). In some embodiments, a direct contact between the cleaning surface 312 and the filter 121 provides an optimal operational distance. However, in other approaches, a small separation distance between the filter 121 and the cleaning surface 312 can be preferred.

Although single piece paddle assemblies can be used, in the depicted embodiment of FIG. 3, a mated pair of paddle sub-assemblies 313 are used together to secure an associated cleaning structure 312 in place. The paddle sub-assemblies can be adhered or otherwise coupled together by a number of fasteners or fastening devices (screws, mounting pins, rivets, and so on). Such fastening can be used to secure the cleaning structures in place although many alternative arrangements of supporting the cleaning structures will be apparent to those of ordinary skill. It is specifically pointed out that other embodiments can employ single piece paddle structures or other suitable paddle and cleaning element structures.

Figure 4A:
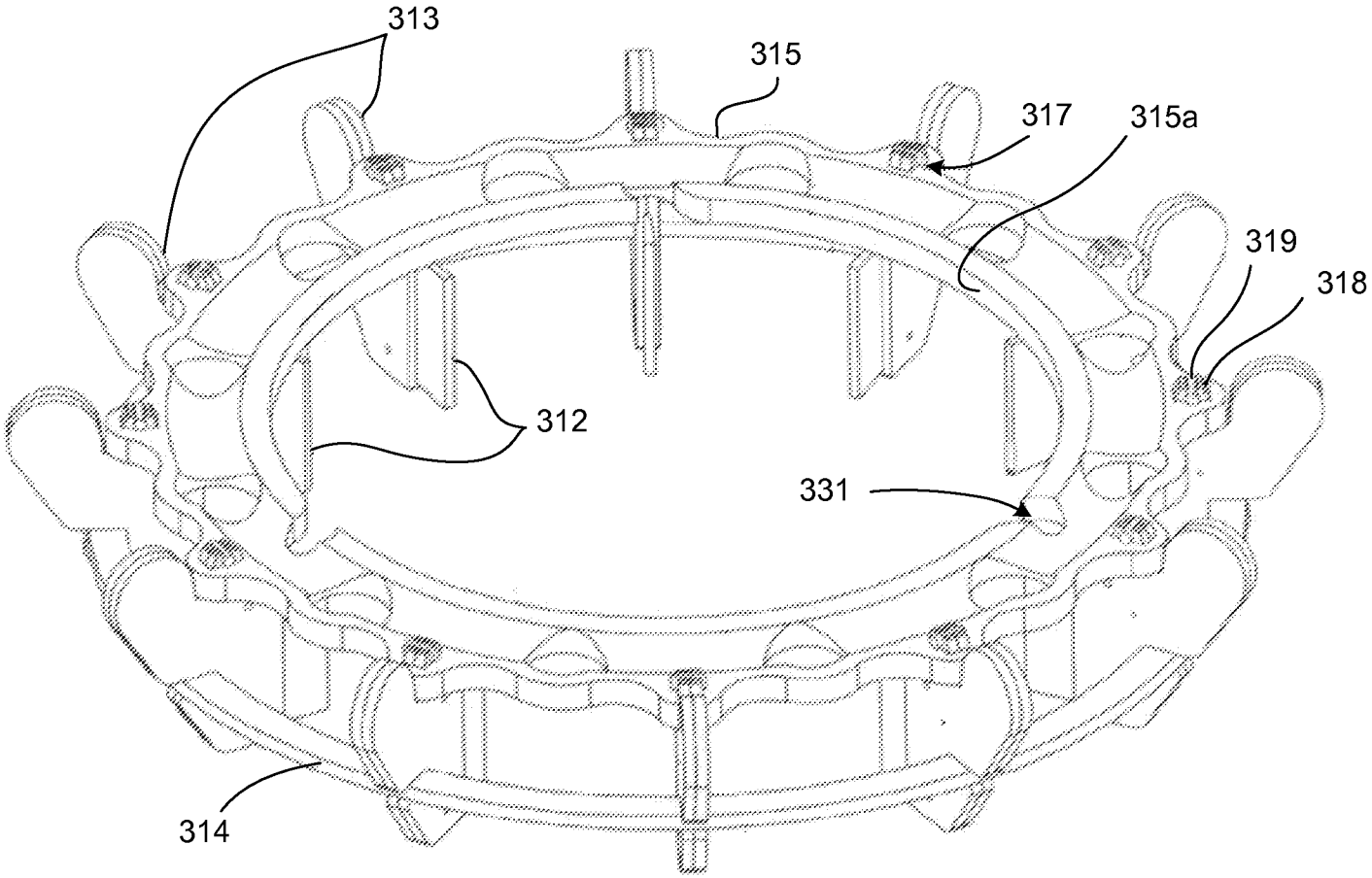
FIG. 4(*a*) is a diagrammatic perspective view of a cleaning assembly including a set of drive paddles as described herein.
Figure 4B:
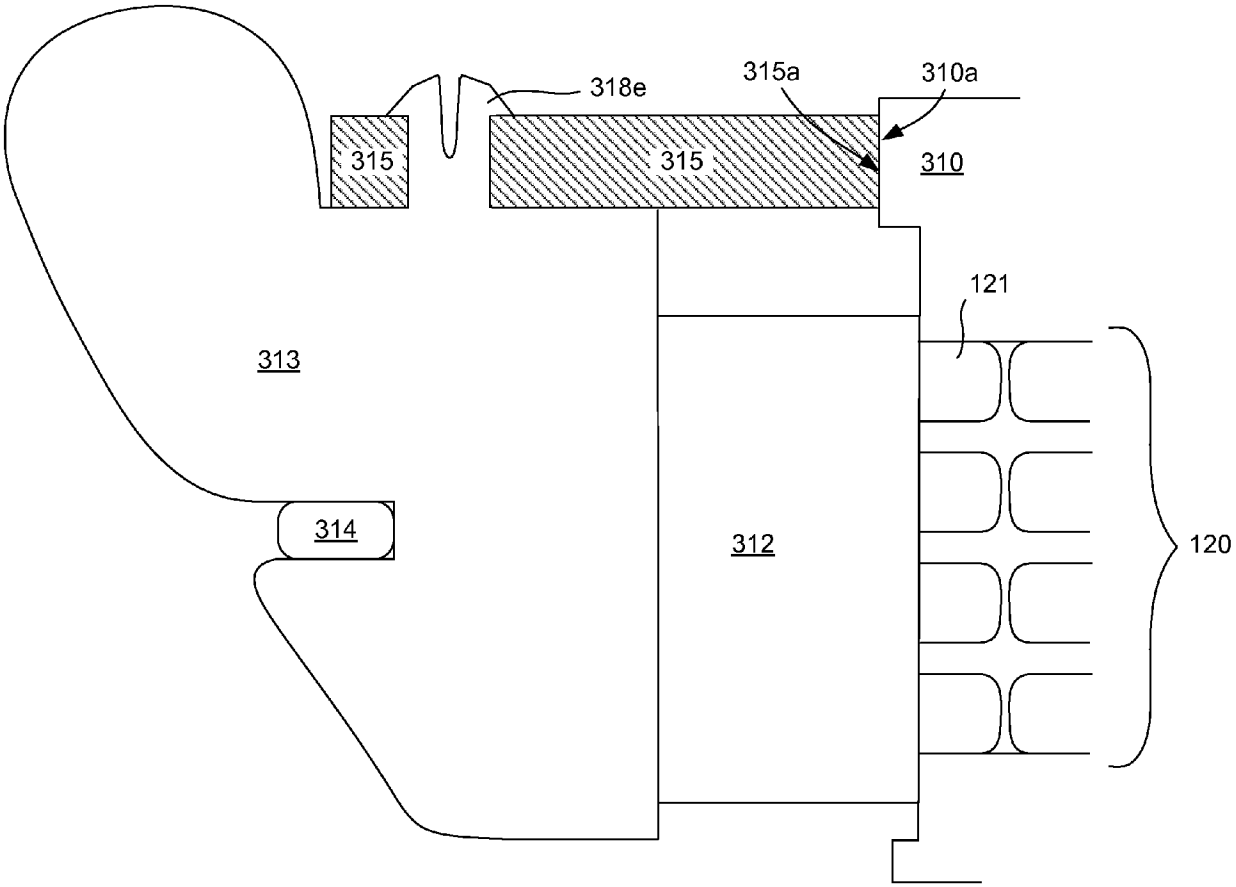
Figure 4C:
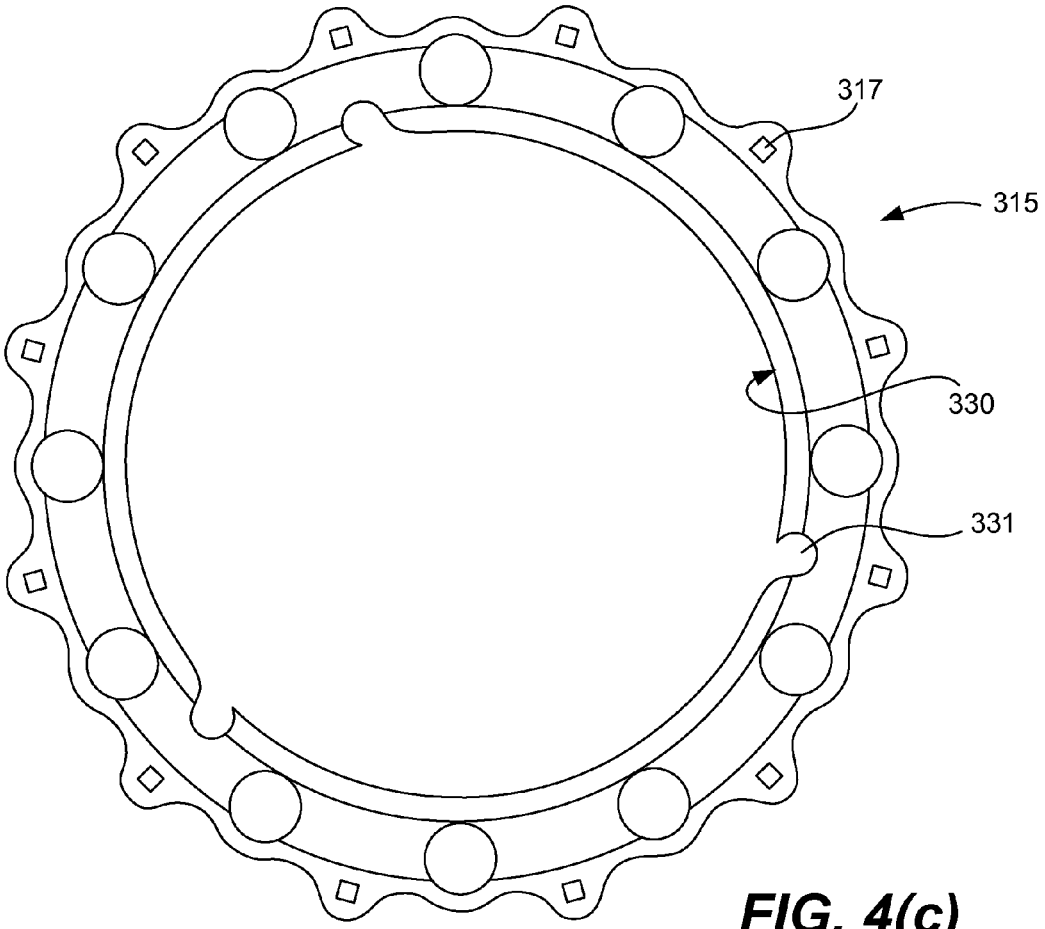
Figure 5A:
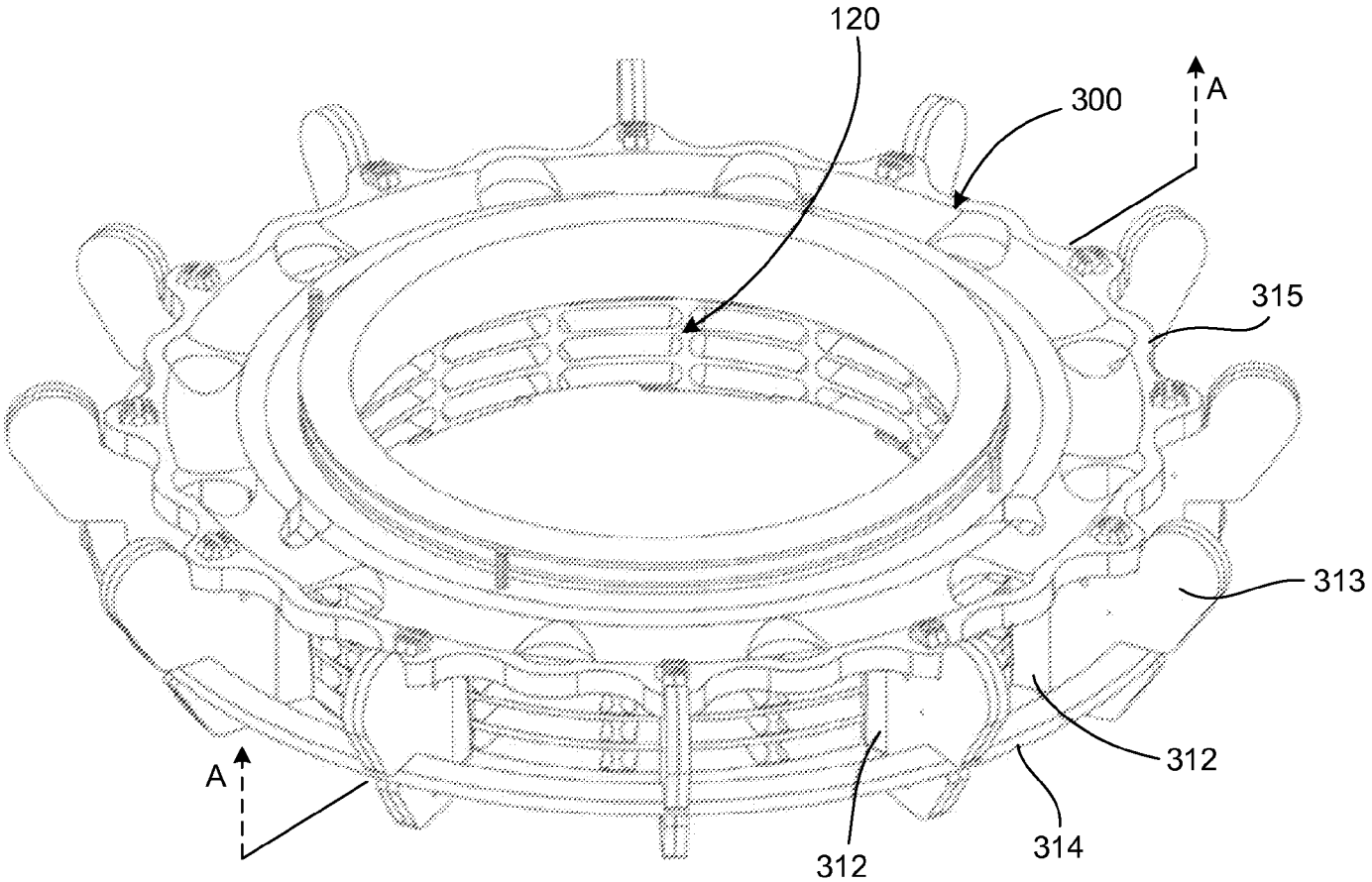
FIG. 5(*a*) is a perspective view of a filter assembly nested inside a cleaning assembly as it would be in one embodiment of an operating arrangement of the hydroclone.
Figure 5B:
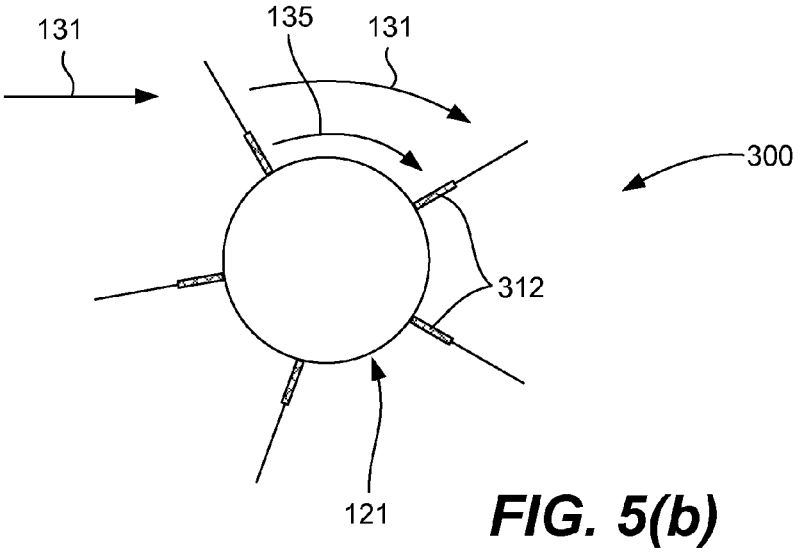
Figure 5C:
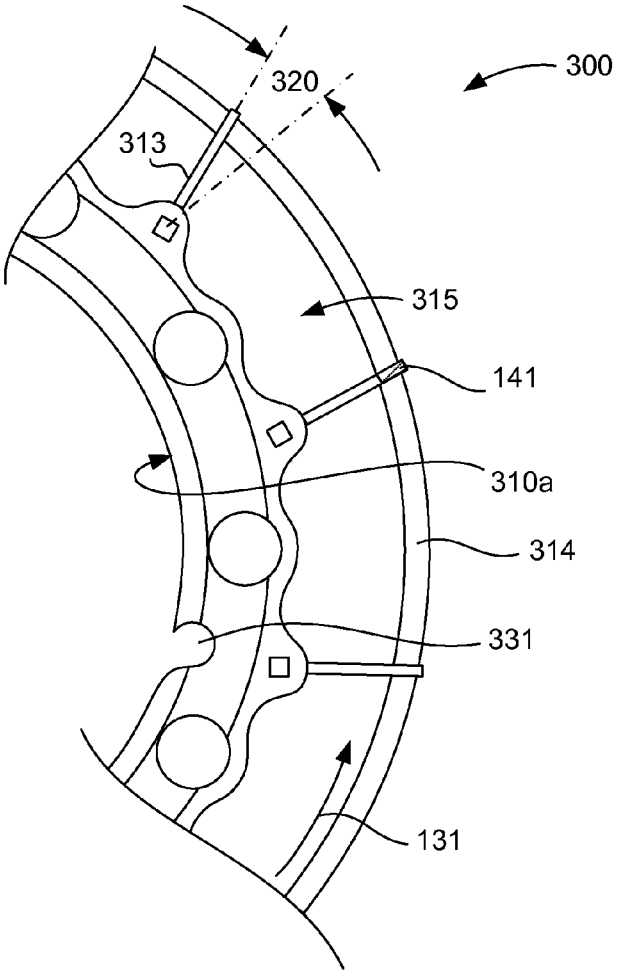
Figure 5D:
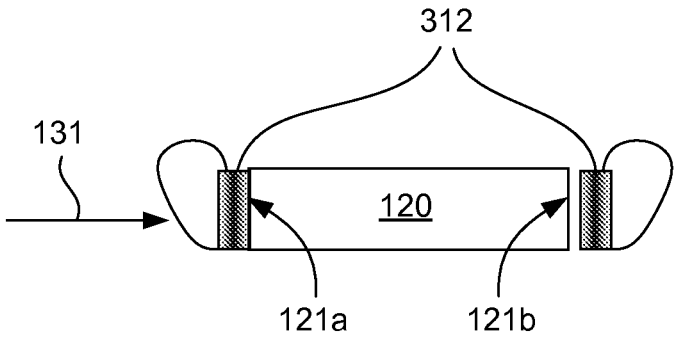
Figure 5E:
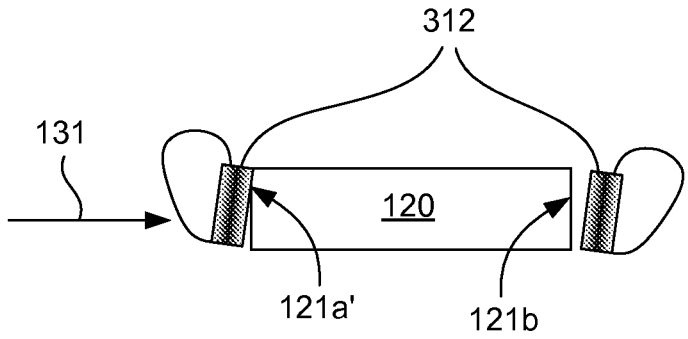
Figure 6A:
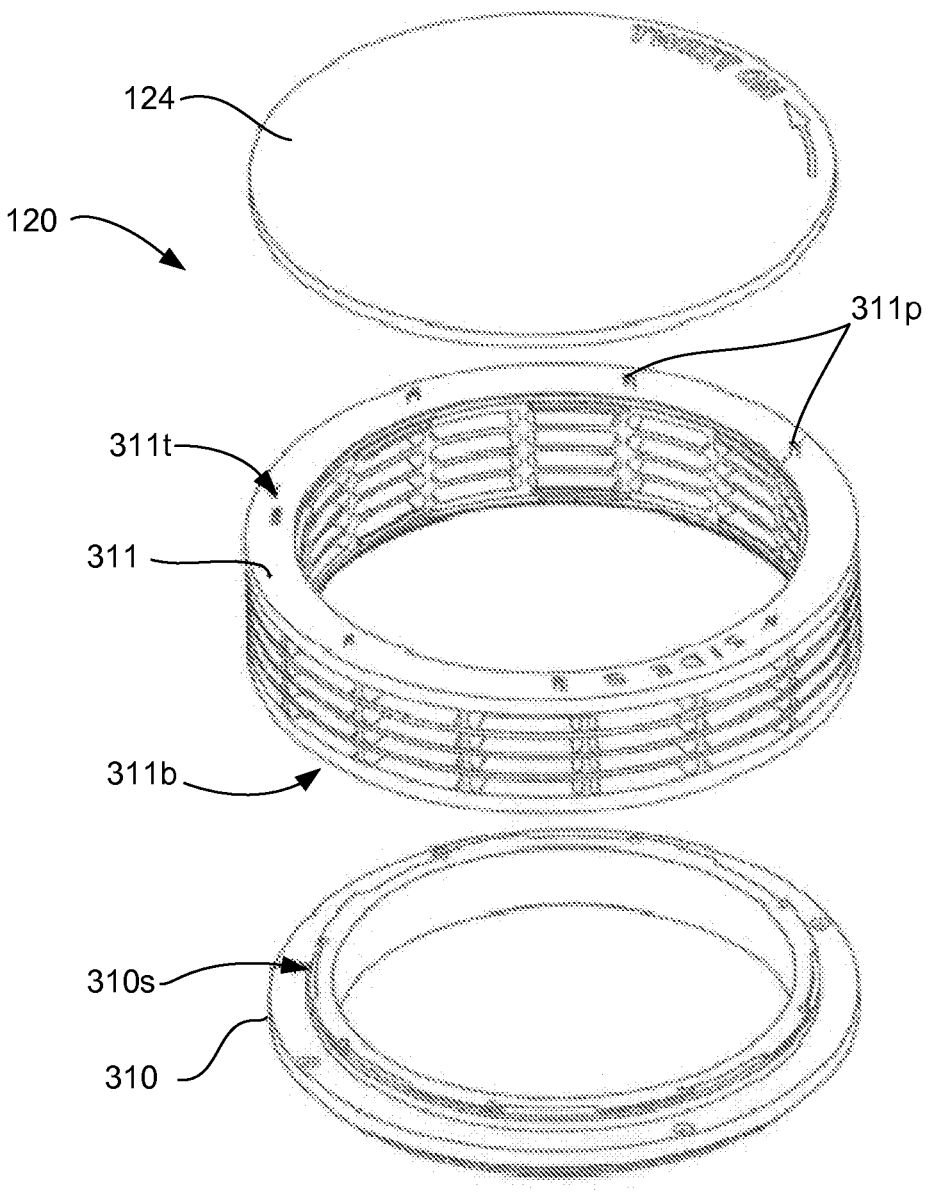
FIG. 6(*a*) is an exploded diagrammatic view illustrating one embodiment of a filter assembly with removable and re-attachable lid and bottom in accordance with an embodiment of the invention.
Figure 6B:
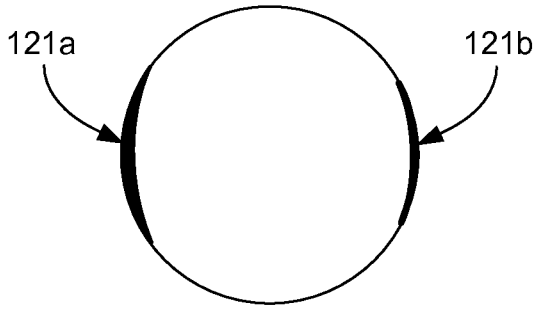
Figure 6C:
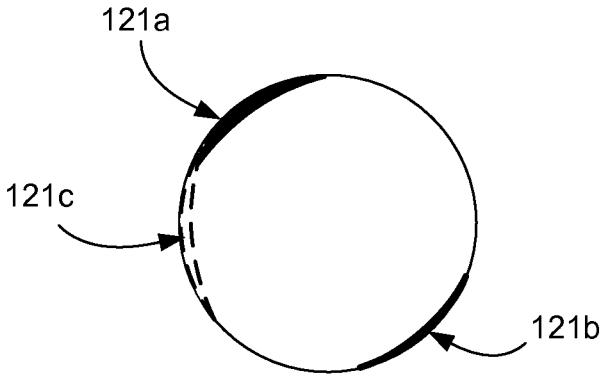
Figure 6D:
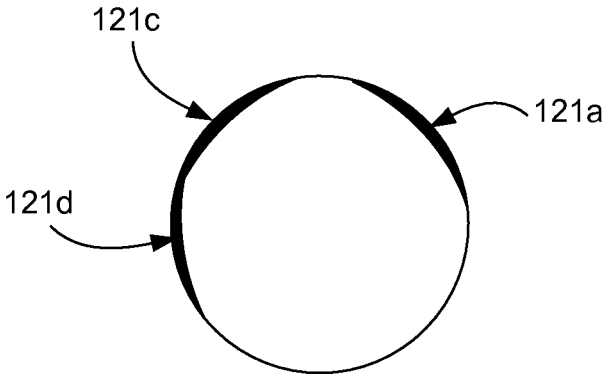
Figure 7A:
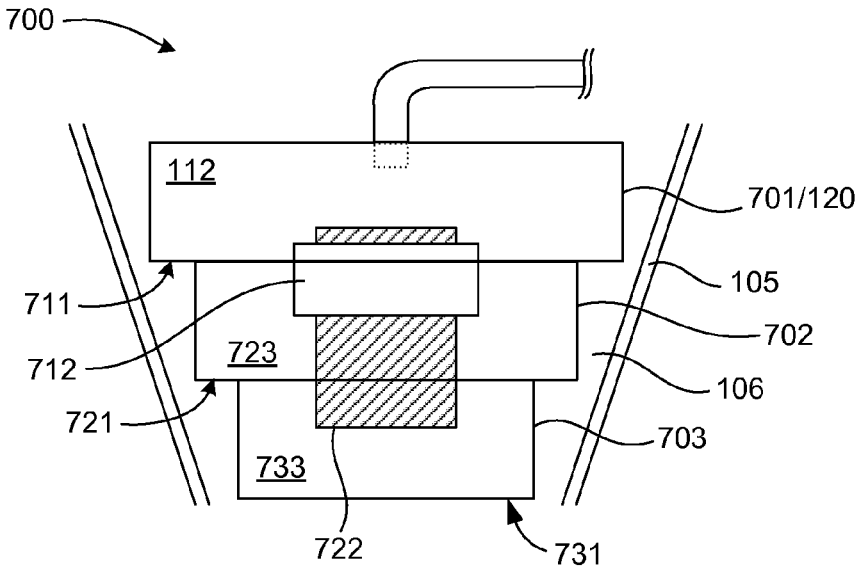
FIG. 7(*a*) is a diagrammatic side section view of a portion of a hydroclone based filtering system arranged in a hydroclone chamber and illustrating the extensible filter stages and connectors in one embodiment of an upper influent inlet.
Figure 7B:
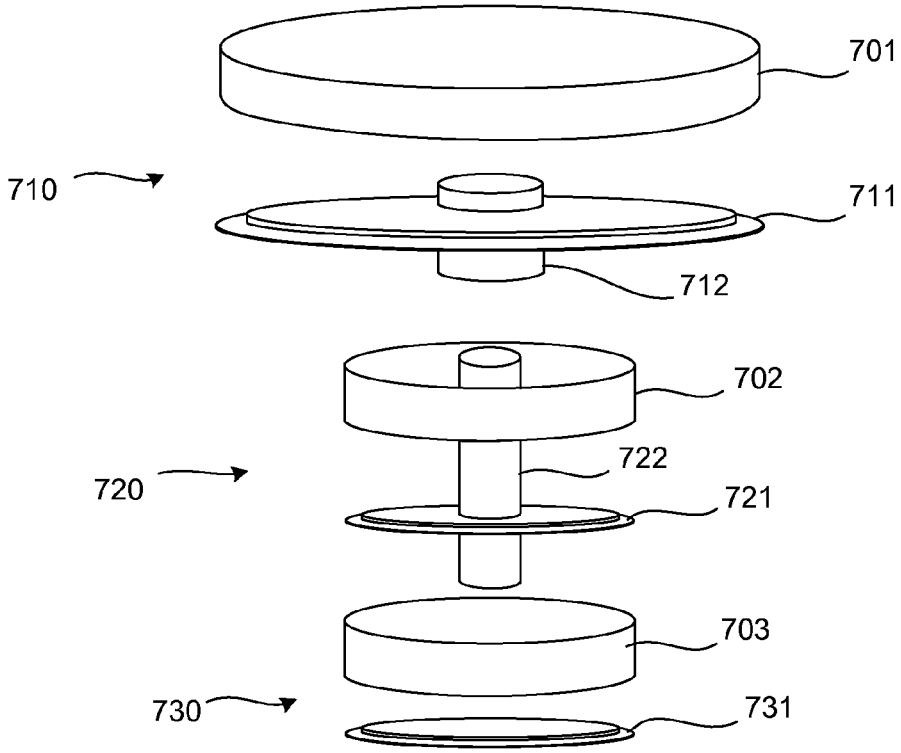
Figure 7C:
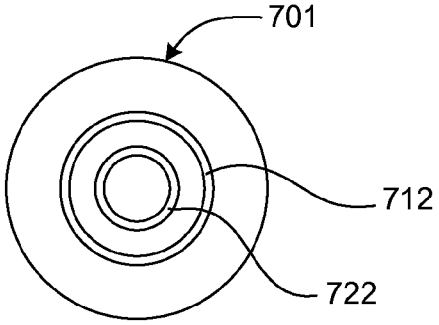
Figure 7D:
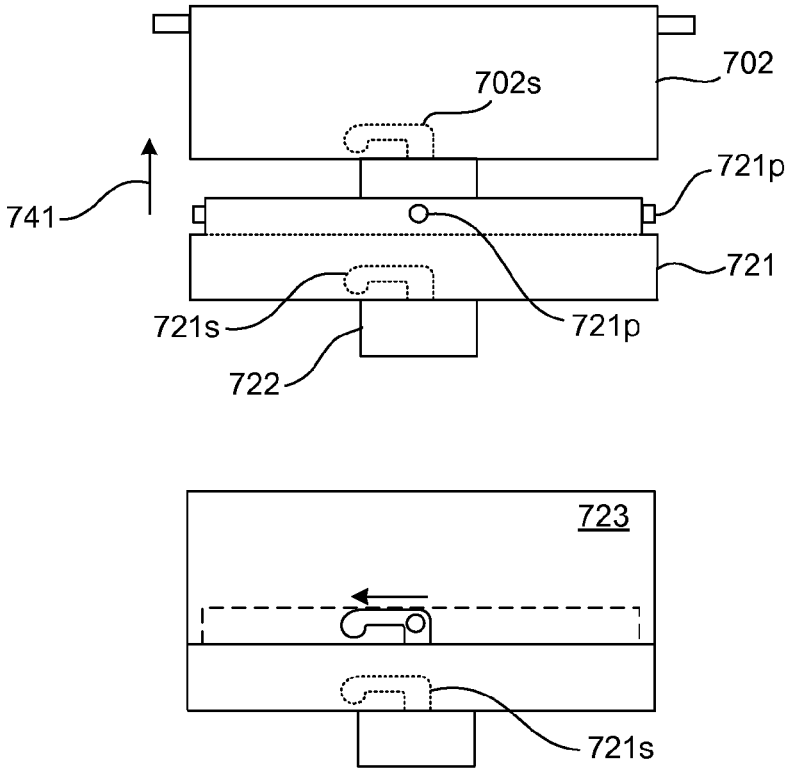

FIG. 4(*a*) shows an assembled cleaning assembly in more detail. As shown, a plurality of paddles 313 support a plurality of cleaning surfaces 312. The paddles 313 engage with a support ring 314 and also engage with a bearing 315. The bearing 315 facilitates rotation of the cleaning assembly 300 about the filter assembly. The support ring 314 provides stability to the cleaning assembly 300. It should be pointed out that although depicted here (FIG. 4(*a*)) as twelve (12) paddles 313 arranged about a robust bearing 315, each paddle associated with an associated cleaning element 312 of the configurations are contemplated. For example, embodiments where there are more paddles 313 than cleaning elements 312 can be used. In fact one advantageous implementation uses 24 paddles while using only 12 cleaning elements.

FIG. 4(*b*) is a more detailed side view of an assembled paddle 313 which shows the arrangement of the cleaning structure 312 as it is journaled about a bearing 310 of the cleaning filter assembly 120 and the filter membrane 121 and further depicts the attachment of a paddle 313 to the bearing 315. In this embodiment, the paddle 313 is engaged with a mated slot in the bearing 315 to secure the paddle with the bearing. Thus, an inner facing surface 315*a* of the bearing 315 is arranged in a journaled position enabling rotation about a support surface 310*a* of attachment ring 310 of the filter assembly enabling the cleaning structure 312 to remain operative to clean the surface filter 121 as it rotates about the filter assembly. Thus, the attachment ring support surface serves as a race for the bearing 315.

Returning to a discussion of FIGS. 4(*a*) and (*b*), the cleaning assembly 300 includes a plurality of assembled paddles 313, each having a cleaning structure 312 arranged in a generally circular configuration. The paddles 313 are engaged with a support ring 314 and also engaged with a bearing 315 that will enable rotation of the cleaning assembly 300 about the filter assembly 120. The engagement features 318/318*e*/319 of the paddles 313 are coupled with receiving slots 317 of the bearing to form a stable support structure.

FIG. 4(*c*) provides a view of the bearing 315 as viewed from the top. The bearing 315 includes a number of receiving slots 317 arranged about its circumference to engage with associated paddles 313 as shown and described previously. The inner surface 330 of the bearing is a substantially circular surface sized to match diameter with an attachment ring 310 of the filter assembly 120 or alternatively an upper mounting portion 140 of the inside of lid 109 depending on the particular embodiment used.

In this embodiment the bearing 315 is somewhat rigid and includes a plurality of cutouts 331 arranged about the inner circumference of the bearing. As mentioned above, the bearing is preferably sufficiently rigid to insure that the cleaning surfaces can be held in their desired orientation relative to the filter surface 121 during rotation even in high vortex speeds and very viscous fluids.

Moreover, to deal with feed fluids 131 having a high concentration of particulate matter the bearing 315 can include particulate removal features. In one embodiment, the features can include cutout features 331. The cutouts 331 enable the particulates to move through and around the bearing 315 and not excessively bind up the cleaning assembly as it rotates around the filter assembly 120. Alternative bearing structures are discussed, for example, in provisional patent application 61/355,989 filed Jun. 17, 2010 "Particulate Tolerant Fluid Bearings for Use in Hydroclone Based Fluid Filtration Systems" which is incorporated herein by reference for all purposes.

FIG. 5(*a*) illustrates a cleaning assembly 300 assembled in a mounted arrangement with a filter assembly 120 (akin to the exploded view of FIG. 3) to form a "nested" assembly 500 as it would be in one example of an operating arrangement of the hydroclone. Here, the filter 120 is nested inside the cleaning assembly 300 and is secured in place using a particulate tolerant fluid bearing 315. The cleaning structures 312 are carried by a set of paddles 313 which in turn are carried by the bearing 315 and supported by a toroid support ring 314. Here, the support ring 314 is arranged as a toroid band that engages an external groove of each paddle. Accordingly, the support ring 314 is easily installed and due to its extended width in a radial direction provides improved radial support for the paddles 313. Although such a toroid support ring is advantageous, it is not a required aspect of the invention.

Cleaning Assembly Modes of Operation

FIG. 5(*b*) is a schematic representation of a section view of a simplified depiction of the assembly 300 such as shown in FIG. 5(*a*) and taken along A-A. In this depiction, a simplified view of the assembly 300 is diagrammatically depicted in a hydroclone induced circulating fluid flow 131. Here, the fluid flow 131 is that generated by the presence of the vortex. The cleaning assembly 300 is shown with the cleaning structures 312 having cleaning surfaces in close proximity to, or in contact with, the filter surface 121. The fluid flow around the filter (the vortex 131) impels a rotational motion 135 to the cleaning assembly 300 enabling the assembly to spin around the filter 120. The rotation aids the cleaning structures 312 used to clean the filter 120. The rotational effect of the vortex can be enhanced when paddles 313 are interposed into the flow 131 of fluid.

The paddles 313 can be added as separate elements or can be part of existing components. Here, the paddles 313 extend radially away from the center of the filter 120 and are generally coplanar with the depicted cleaning structures. In some embodiments, the paddles 313 are merely extensions of the cleaning structures 312.

With reference to FIG. 5(*c*) is a top plan view of a portion of the cleaning assembly 300. This view specifically illustrates an embodiment having cleaning paddles 313 that are arranged at an angle other than radially disposed on the bearing 310. Here the paddle 313 is angled away from perpendicular to the vortex flow 131. This angle 320 can be at any angle directed away from the tangential flow 131 of the vortex fluid and other than radially disposed on the bearing 315. Angles 320 ranging from about 5°-45° have been particularly useful with an angle 320 of about 12.5° being preferred. Such an angle is optimized to be perpendicular to a fluid flow directly from the inlet 101 (see, for example FIG. 1) just a bit sooner than went the flow from the inlet 101 is tangential to the cleaning assembly. Surprisingly, this has been found to generate higher rotational speed in the cleaning assembly and superior cleaning of the filter 120. It should be pointed out that the paddle geometry should in no way be limited to the specific examples provided here.

Additionally, in some situations the inflowing fluid 131 through inlet 101 can exert an uneven force on the cleaning assembly 300 which results in uneven wear on the surface 121 of the filter 120. One example of such an uneven wear condition is illustrated and described using the exaggerated diagrammatic depiction of FIG. 5(*d*). For example, the cleaning structure 312 on the side closest to the inlet 101 is pressed against the associated portion 121*a* of the filter surface 121 by, for example, the inflowing fluid stream 131. Not surprisingly, this causes more wear to be incurred at upper portion 121*a*' of filter surface 121 on the side facing the inlet 101 and lesser wear can occur on opposing side 121*b* of the filter surface 121. Thus, FIG. 5(*e*) illustrates this increased wear on one side (121*a*') of the filter relative to other portions of the filter (121*b*).

An advantage of the filter design described below and usable in the system above is that the filter assembly 120 can readily be disassembled, the filter frame 311 can be simply and easily be flipped over and the filter reassembled with a top portion of the filter now being on the bottom. By flipping the filter upside down, the worn portion 121*a*' of the filter assembly is, moved to the bottom and thus away from the upper region of heavy wear. Thus, the useable life of the surface filter can readily be extended. This is sometimes desirable because fine filter membranes can be relatively expensive.

Referring next to FIG. 6(*a*), both the attachment ring 310 and the bottom plate 124 of the filter assembly 120 are reversibly attachable to and detachable from the filter frame 311 thereby facilitating reversal of the filter. The specific devices used to secure the attachment ring 310 and the bottom plate 124 to the filter assembly may be widely varied. For example, the components (top attachment ring 310 and bottom plate 124) can be attached to the filter frame 311 using almost any type of reversible mechanical fastener. For example, attached using screws or other reversible fasteners, clasps, clamps, clips, mated threaded features enabling the components to be screwed or unscrewed. Of particular utility is a pin and groove "bayonet" type attachment device. In one example, one component (bottom plate 124 or filter frame 311) is configured with pin features with the other component (the other of filter frame 311 or bottom plate 124) having complementary groove or pin receiving features. Although described using a simple pin and groove lock "bayonet" type attachment feature, the invention is not intended to be limited to just the enumerated features but is intended to cover numerous possible alternatives such that a sufficient fluid seal is provided and that the attachment is reversible. The idea being that the bottom plate 124 can be removed from a first side 311*t* of the filter frame 311 and reattached to a second side 311*b* of the filter frame 311.

In a similar fashion, upper attachment ring 310 can be reversibly attachable with the frame 311. For example, the frame 311 and attachment ring 310 can also be attached using almost any type of reversible mechanical fastener. As before, of particular utility are pin and groove "bayonet" type attachment features with one component having pin features with the other component having complementary groove locking features. As shown here, a top side 311*b* (of frame 311) is configured with pins (not shown in this view) having a mated set of associated retention slots 310*s* on the attachment ring 310. The pins are engaged with the slots 310*s* and then the frame 311 can be twisted to engage the pin and slot fastener in a locking position. It is intended that the process also be reversible. Many versions of such pin and slot "bayonet" fasteners can be used.

In one implementation, after a certain degree of wear occurs on a portion of the filter assembly 120, bottom plate 124 and top attachment ring 310 are removed from the frame 311. The frame 311 (and surface filter 121 mounted thereon) is then flipped over and the bottom plate 124 and top attachment ring 310 are remounted on the frame 311 in the reverse order such that the bottom plate 124 is mounted on side a top and the attachment ring 310 is mounted on side 311*b*.

As described above with respect to FIG. 5(*d*), another uneven wear situation occurs when the wear is more substantial on one side of the filter than the others (e.g., when greater wear is occurring at side 121*a* as compared to side 121*b* To mitigate this problem, the filter can periodically be disassembled and indexed (i.e. rotated) relative to its present position. One mechanism for facilitating such rotation will be described with reference to FIGS. 6(*a*)-6(*d*). As mentioned above, the attachment ring 310 may be fixed onto the lid 109 of hydroclone 100, for example using screws (or other fasteners). To facilitate rotation of the filter, the frame may have a multiplicity of pins 311*p* located on its top and bottom surfaces (pins located on side 311*b*, are not shown in the view of FIG. 6(*a*)). The pins are arranged to engage with complementary features 310*s* of the attachment ring 310. It should be appreciated that the filter frame 311 can be engaged with the features 310*s* in a number of orientations to selectively position the frame 311 to extend the filter life. The views in FIGS. 6(*b*)-6(*d*) illustrate how selective engagement and partial rotation of the filter can extend filter life. In one such embodiment, at least three features 310*s* are configured to engage at least three pins 311*p* (sets can be on either side 311*t* or 311*b*). In some embodiments, many more than three pins 311*p* and features 310*s* are used and such pins and features are symmetrically disposed around the frame 311 and equidistant from each adjacent feature.

Again referring to FIGS. 6(*b*)-6(*d*) when wear at a selected portion 121*a* reaches a certain point, the frame 311 can be disengaged from the lid 310 by twisting the frame 311 such that the pins disengage from the locking features 310*s*. The frame is then rotated to another locking position and then re-engaged using the pins and locking features. For example, upon disconnection, rotation, and reattachment, FIG. 6(*c*) the filter is oriented so that the most worn portion 121*a* is rotated away from the most wear vulnerable position. Thus, by way of continued example, upon further disconnection, rotation, and reattachment, FIG. 6(*d*) the filter is again re-oriented so that the most worn portion 121*c* is also rotated away from the most wear vulnerable position. In an example embodiment, an indexed partial rotation of about 60 degrees per partial rotation can be used. Of course partial rotations of other magnitudes can be used. Thus, although portion 121*c* is subject to increased wear it can be index away from the high wear location by using partial rotation. Accordingly, a relatively unworn portion 121*d* is now moved into the position of increased wear. It is to be noted that the features of rotating the filter and flipping it over can be combined if necessary or if desired.

Extensible Filter Assembly

In some embodiments, such as the embodiment shown in FIG. 2, a single filter assembly 120 is placed inside the hydroclone chamber 106. Such an approach provides excellent filtering capacity. However, if it becomes desirable to expand the filtering capacity of a given hydroclone device, the invention as described below, can achieve this goal with great flexibility and utility.

With reference to FIGS. 7(*a*)-7(*c*), a simplified extensible filter embodiment is described. A stacked filter assembly 700 can replace the single stage assembly depicted, for example, in FIG. 1. In this embodiment a plurality of filter stages (here, 701, 702, 703) can be used to replace the single stage filter of the previously described embodiments.

In the depicted embodiment a first stage filter element 701 can be substantially the same as filter 120 described with respect to FIG. 2 with some differing features. Instead of a single cylindrical filter, the extensible filter assembly 700 can be used instead. As shown here the extensible filter assembly 700 comprises a number of stages. Any approach using two or more stages can be used. In this embodiment, three stages (701, 702, 703) are used, with each stage 701, 702, 703 including a filter frame and surface filter. The stages are arranged such that filter frames have decreasing diameter as the stages extend downward toward the bottom of the hydroclone chamber 106. The frames having progressively smaller diameter in general relation to the angle of the chamber wall 105. It is pointed out that in some embodiments, the filter elements can be the same size.

A number of co-assigned patents and patent applications have described the use of stepped and/or frusto-conically shaped filter assemblies within the hydroclone chamber. Although such filter assemblies work very well in many applications, under certain operational conditions the pressure gradients in the hydroclone chamber 106 and the filtered fluid chamber respectively may be such that some reverse fluid flow (i.e., filtered fluid flowing out of the filter through the membrane into the regions containing unfiltered fluid) occurs through certain portions of the filter, which reduces the filtration efficiency. In filter chambers that drain filtered fluid out the top of the filtered fluid chamber, the reverse fluid flow is most likely to occur near the bottom of the filter.

The risk of reverse flow can be mitigated by effectively separating the filter assembly into several smaller chambers that are each in communication with the outlet 107 and upper chamber 112 but substantially isolated from direct communication with each other. This can be facilitated by using specialized isolation manifolds with fluid connectors described as follows.

The stacked filter assembly 700 of FIG. 7(*a*) includes a first filter stage 701 and a plurality of supplementary stages (here 702, 703). The top filter assembly (first stage) 701 can be substantially similar to the filter assembly 120 described above. An important difference is illustrated using FIGS. 7(*a*)-7(*b*). The bottom plate of filter 120 is removable and can be replaced with an isolation manifold 710 arranged at the lower portion of the first filter stage 701. As shown in this embodiment, the isolation manifold 710 includes a flow connector 712 and an isolation member 711. The connector 712 passes through the isolation member 711. When reattached and secured to a bottom portion of filter 701 the isolation manifold 710 (via connector 712) enables fluid communication between chamber 112 and chamber 723 (defined by an underlying second (supplementary) filter stage 702). Thus, the connector 712 enables an equalization of fluid pressure between chamber 112 and chamber 723. Thus, the member 711 operates as a fluid barrier confining fluid flow between the two adjacent chambers. Accordingly, it minimizes free fluid movement within the filter assembly as would be the case in the absence of the isolation manifold. In this way, the outflow of filtered fluid from the filter assembly to the main chamber 106 is substantially reduced thereby enhancing the filtration efficiency of the system.

In continuing explanation of this embodiment, and as described in the exploded view of FIG. 7(*b*), in one embodiment the connector 712 of the isolation manifold is centrally located to enable the addition of further filter stages as explained below. However, it is to be noted that in other embodiments the connector 712 can be offset from the center location depicted here. Additionally, in other embodiments several such connectors 712 can be arranged in the member 711.

As shown in this example, a third (supplementary) filter stage 703 can be arranged under the second filter 702 which can be similar to the filters above excepting that it has a lesser diameter. As with the filter stages described above and illustrated in FIGS. 7(*a*)-7(*b*), another isolation manifold 720 (for the second filter stage 702) includes a connector 722 that passes through the isolation member 721 enabling fluid communication between chamber 112 and chamber 733 defined by a third filter stage 703. In this embodiment and as shown in FIG. 7(*b*), the isolation manifold 720 has a connector 722 that is also centrally located which enables the centrally located connector 722 to pass through the inside of connector 712. The diameters of connectors 712, 722 are such connector 722 can fit inside connector 712. This enabled direct fluid communication between chamber 112 and both chambers 723, 733 without enabling flow between the second chamber 723 and the third chamber 733. Also, in other embodiments, the connectors 722, 712 can be offset from the center locations depicted here.

Although depicted here as three filter stages 701, 702, 703 (each configured similarly to filter stage 120) the invention contemplates embodiments having more or fewer filter stages. As with the above described stages, each stage can have an isolation manifold that is in communication with the upper chamber 112 but not in direct communication with the other chambers. This structure is freely extensible to accommodate as many filter stages as desired. At the lowest filter stage (here stage 703) a bottom cap 731 is installed to cap off the bottom of the filter assembly 700 preventing the intrusion of unfiltered fluids.

FIG. 7(*c*) is a diagrammatic top down view of a portion of a filter assembly 700. In this depicted embodiment, stages 701 and 702 are engaged with each other and filter stage 702 is engaged with stage 703. Also depicted are isolation manifolds 710, 720, associated members 711, 721 and the associated connectors 712 and 722. It is to be noted that in this particular embodiment, the connectors 712 and 722 are coaxially arranged one inside the other. Although the invention contemplates non-concentric implementations the depicted embodiment is preferred. Accordingly, connector 712 is positioned inside the inner diameter of connector 722 thereby enabling fluid to flow up into chamber 112 from chamber 733 and likewise from chamber 723 to chamber 122. Importantly, the fluid flow is accomplished without free fluid flow between chambers 723 and 733 (these being isolated from direct communication between each other). In this manner the fluid pressure is substantially the same in all of the chambers 112, 723, and 733.

Additionally, FIG. 7(*d*) illustrates one approach for attaching a manifold at a filter stage to enable flexible extensibility of the filter assembly 700 per the needs of the system. Instead of a standard bottom (e.g., like 731) another bottom (like isolation manifold 721) can be employed. One example of such an isolation manifold 721 is described. A filter frame (e.g., 702) is provided. An isolation manifold (e.g., 721) replaces the standard bottom. In this depiction the bottoms and isolation manifolds are configured to be easily replaceable and interchangeable. In one example, the filter frame 702 can include a bayonet-type locking feature (e.g., slot 702*s*) into which a locking pin 721*p* of isolation manifold 721 can be fitted. For example, the pin, or a set of pins 721*p* is aligned with a complementary locking feature 702*s* (features) that (in this embodiment) are arranged at an inner diameter of the frame 702. The pin(s) 721*p* are aligned feature(s) 702*s* and engaged by moving the pins upward 741 and then twisting 742 the pin 721*p* and locking feature 721*s* to fully engage. This can affect a solid lock between the two components. Further, seals can prevent fluid leakage into or out of the chamber 723. As can be readily appreciated, many other reversible engagement features can be employed to extensibly attach a series of filter frames together to form a stepped filter. In some embodiments the isolation manifold 721 can include locking features 721*s* that can enable further extensibility of the attachment of a standard bottom piece (i.e., a bottom piece without a connector, e.g., 722).

To enable cleaning, added fluid bearings and cleaning assemblies can be added independently at each stage. Alternatively, one large integrated cleaning assembly can be employed that includes cleaning elements at each stage arranged to help clean the filters of each stage while rotating around the stacked filter assembly. In one embodiment, such an assembly can use a bearing at the upper filter stage (120, 701) and another bearing at the lowest one (e.g., 703). Additionally, further intermediate bearings can be included to engage mounting surfaces on one or more of the supplementary filters if added stability is desired. It is readily apparent that other arrangements can be employed with similar results.

Pressure Equalization

In some operating conditions, the filter clogging can become serious enough such that before the cleaning assemblies cannot clean the filter surfaces effectively. This clogging can also impair the effectiveness of the filters themselves thereby reducing the rate of filtration substantially, and thereby reducing the throughput of filtered fluid by the system. Again referring, to FIG. 2 it is believed that a pressure differential between the unfiltered fluid in the hydroclone chamber 106 and a filtered fluid chamber within the filter assembly (e.g., 112) can aggravate this clogging problem. For example, a pressure differential between the higher pressure in the fluid circulating region 106 and a low pressure inside the filtered fluid chamber(s) (e.g., 112, 723, 733) can push particles and other contaminants against the side the filtered fluid chamber(s) blocking filtration pores and making it difficult to clean the filters elements/membranes of the various stages (120, 701, 702, 703, etc.). The effect of this build up is to degrade cleaning effectiveness of the filtration device.

One approach for increasing the cleaning effectiveness of the cleaning assemblies is to control the pressure differential between the inside and outside of the filter assembly. For example, an inventive pressure management system can be used to operate hydroclone devices such that the aforementioned pressure differential is maintained within a specified operational range. In one example, the pressure management system can be used to equalize the pressures between the inside of the filtered fluid chamber(s) and the outer fluid the fluid compartment 110/106. The filtration management system can include pressure detectors 132, 134 arranged to detect a pressure differential between the filtered fluid chamber(s) (112, 723, 733, etc.) and the external fluid compartment 110/106. This information can be received by a regulator system 133 that can operate to equalize the pressure differential. A wide range of pressure detection systems can be used. For example, the invention can include, but are not limited to pressure sensors including one or more of mechanical and hydraulic pressure sensors, electrical pressure sensors in general, piezoelectric transducers, resistive strain gauge transducers, capacitive transducers, electromagnetic transducers, optical transducers, potentiometric transducers, resonant frequency transducers, MEMS technologies, thermal transducers, as well as many others. The regulator 133 can equalize the pressure using a number of approaches including, but not limited to reducing or shutting off the influent flow 131 through the inlet 101, reducing or shutting off the outflow 107 of filtered fluid from the inside (e.g., 112) of the filter element(s) (e.g., 120), introducing air or gas into the filtered fluid chamber(s)(e.g., 112). The invention contemplates that many other approaches can be used as well.

In one particular embodiment, a differential pressure threshold is set in a desired cutoff range (in one example, between about 1 psi. to about 3 psi). Once set, the hydroclone undergoes normal operation with each pressure sensor 132, 134 measuring the pressure in the respective chamber. Pressure information is received by a regulatory system 133 which is configured to take the appropriate action. For example, in one embodiment piezoelectric pressure sensors 132, 134 measure the pressures in the associated chambers and provide pressure information to a microprocessor 133. The microprocessor 133 can generate differential pressure information and when said differential pressure varies outside the desired range, the microprocessor can initiate a predetermined remedial action. For example, in one embodiment, where the measured differential pressure exceeds the predetermined threshold (for example, where the pressure in chamber 106 is significantly greater than the pressure inside chamber 112) remedial action is taken. In one case, the influent flow 131 can be reduced or stopped, allowing the two pressures to equilibrate. Once equilibrium is reached, the inlet 101 flow can be returned to normal operating conditions.

RPM Monitoring

In some embodiments, it is important to maintain the rotation rate of the cleaning assembly 300 within a desired operational range. Numerous factors can play into this, including, but not limited to fluid viscosity, optimized rotation rates for filter cleaning, desired vortex speeds, and so on.

Therefore, it can be advantageous to have a method of measuring cleaning assembly rotation rates. In some embodiments it can serve as an accurate measure of vortex velocity in the fluid circulating region 110 as well as a measure of the rotation rate of the cleaning assembly 300.

Although many different approached can be taken, such approaches must be sensitive to the sometimes difficult environment of contaminated viscous fluids. Although, simple optical or electrical methods can be used. The invention includes a particularly robust and serviceable embodiment using simple magnetic measurement of rotation rate for the rotating cleaning assembly 300. In the depicted embodiment 300 as shown in FIGS. 2 and 5(*c*) a rotation rate measurement system is briefly described. A very basic embodiment comprises a marker 141 arranged on some rotating location on the cleaning assembly 300 and a transducer 142 arranged to detect the rotational rate and controller element 143 arranged to receive data from the transducer 142. The controller element 143 can be used to monitor and/or regulate the rotation rate of the cleaning assembly 300. Such regulation can be accomplished, for example, by reducing the inflow rate through inlet 101 as well as other approaches.

In the depicted embodiment, the marker 141 can be a magnet arranged on the assembly 300. For example, a magnet 141 can be arranged on one of the paddles 313 and a magnetic transducer 142 can be arranged to detect the magnet 141 as it passes near the transducer. This information can be received from the transducer 141 at the controller element 143. Depending on the fluid viscosity, optimized cleaning rpm, and other factors, the controller element 143 can then adjust the rotation rate of the cleaning assembly to optimize or otherwise regulate the cleaning assembly rpm. In this implementation, a magnet and associated magnetic transducer are desirable because they are relatively simple components and function well even in highly viscous and very low visibility environments. The invention specifically contemplates that a wide variety of other sensing technologies can be used to detect the rotational speed of the cleaning assembly.

The described hydroclones can be used in a wide variety of water filtering, pre-filtering and water treatment applications. By way of example, many drinking water treatment facilities use a series of screens and consumable filters that have progressively finer filtering meshes. The described hydroclone can be used in place of one or more staged filter devices. The hydroclone is particularly well suited for applications that require low maintenance; applications that begin with relatively dirty water; and applications that require a relatively small filter footprint while handling a relatively large volume of water through the filter.

The described hydroclones are well suited for use in relatively small scale drinking water filtering applications. In drinking water applications that require very high levels of filtering, the hydroclone is very well adapted for use as a pre-filter (as for example a 5-20 micron prefilter). Since the hydroclone utilizes a surface filter as opposed to a consumable depth filter, fewer filter stages are typically required to pre-filter the drinking water. In water filtration applications that permit larger (e.g. 2-10 micron) particles, the hydroclone can be used as the final filter.

The described hydroclones are also very well suited for ballast water filtering applications. As will be appreciated by those familiar with international shipping, many cargo (and other) ships utilize ballast water for load balancing. Environmental concerns have caused some countries to require (or contemplate requiring) ships to filter their ballast water before dumping it back into the sea. Since the described hydroclones require little maintenance and are very compact for the volume of water they can handle, they are well suited for ballast water treatment applications.

Such hydroclones can be used in produced water applications in the petrochemical industry where large amounts of water are to be returned to subsurface formations.

In various filtering applications, multiple hydroclones can be plumbed together in parallel or in series. Typically hydroclones having the same filter mesh size would be plumbed in parallel to facilitate handling a greater volume of water. Graduated filtering can be accomplished by plumbing hydroclones having progressively smaller meshes together in series.

In general, a representative hydroclone-based water filtration system that includes a hydroclone is described herein. The system draws a fluid to be filtered (water, petroleum, etc.) from a source. In the case of water, any suitable water source can be used, including river water, well water, collected water, bilge water or any other suitable source. The source water is delivered to the hydroclone which can act as a final filter, or more commonly, acts as a prefilter. Filtered water that exits the hydroclone can be directed to further fine filters that filter particles down to a further level (e.g. 1 micron or less) that is desired in the particular application (e.g. for drinking water). By way of example, fine filters having mesh sizes of 5 and 1 micron respectively work well with a hydroclone having a filter pore size of 10 microns. Of course, in other applications, fewer or more or no fine filters could be used downstream of the hydroclone. In still other applications a pair of hydroclones having different opening sizes may be used as the prefilters. Such an arrangement is particularly appropriate when the source water is considered quite dirty (i.e., has a high concentration of suspended particles).

After passing through the filters, the clean water can be directed to a bacterial control unit for further treatment. Any of a variety of conventional bacterial control units may be used in the water treatment system. By way of example, germicidal ultraviolet light and ozone are the two most common non-chemical bacterial control mechanisms used in water treatment systems.

After passing through the bacterial control unit, the water may be stored in a clean water storage tank or drawn as clean water. Water that is intended for drinking may optionally be passed through an activated carbon filter, reverse osmosis filtration units, or other enhanced filtration devices if desired, before it is delivered to a final downstream location (e.g., a tap, a storage tank, and so on). As will be appreciated by those familiar with the art, carbon filters are well suited for removing a variety of contaminants that may remain even in highly filtered water.

Although only a few embodiments of the invention have been described in detail, it should be appreciated that the invention may be implemented in many other forms without departing from the spirit or scope of the invention. For example, although a few specific applications have been described, the hydroclones may be used in a wide variety of other filtering applications. Additionally, there are some applications where it is desirable to concentrate particles that are suspended within water (or other fluids) in order to recover the particles. A hydroclone that has been plumbed for recirculation of the effluent stream is particularly well adapted for use in such concentrating applications, particularly when the hydroclone is operated in the periodic purge mode. In these applications, it may be the concentrated purged fluids that contain the effluent of interest.

Although specific components of the hydroclone such as specific filters, cleaning assemblies, and intake structures have been described, it should be appreciated that the various devices may be used in combination or together with other suitable components without departing from the spirit of the present inventions. Therefore, the present embodiments are to be considered as illustrative and not restrictive and the invention is not to be limited to the details given herein, but may be modified within the scope and equivalents of the appended claims.

What is claimed is:

1. A centrifugal separation enhanced filtration device comprising:

a tank having a fluid inlet, a filtered fluid outlet, an effluent outlet and an internal chamber having an internal chamber wall;

the filtered fluid outlet arranged to extract filtered fluid from a filter assembly arranged within the internal chamber; wherein the filter assembly comprises a staged filter assembly comprising a plurality of filter stages including a first stage and at least one supplementary stage, with each of said filter stages comprising a filtered fluid chamber inside an associated filter membrane arranged to filter fluid in the fluid circulating region wherein filtered fluid enters said filtered fluid chamber of each filter stage, and wherein the filtered fluid outlet is arranged to extract filtered fluid from the filtered fluid chamber of the first stage, and said at least one supplementary stage is configured such that the filtered fluid chamber of said at least one supplementary stage is in communication with the filtered fluid chamber of the first stage but not with another one of said at least one supplementary stages;

a fluid circulating region in a space between the internal chamber wall and the filter assembly; and a circulating cleaning assembly positioned in the fluid circulating region between the chamber wall and the filter assembly, wherein the circulating cleaning assembly includes at least one cleaning element arranged to help clean a filter membrane of the filter assembly when the circulating cleaning assembly is rotated about the filter assembly.

2. The filtration device recited in claim 1 wherein each supplementary stage includes a manifold that prevents direct fluid circulation from the supplementary stage to an adjacent stage and each manifold comprises a connector enabling filtered fluid communication between the first stage and the filtered fluid chamber of each supplementary stage.

3. The filtration device recited in claim 2 wherein the connectors of each manifold are arranged coaxially one connector inside another such that connectors associated with lower stages are arranged inside connectors associated with stages that are closer to the first stage.

4. The filtration device recited in claim 1 wherein the staged filter assembly comprises an extensible filter assembly that is configured to enable additional supplementary filter stages to be added to the staged filter assembly.

5. The filtration device recited in claim 1 further including a pressure management system which is configured to operate the filtration device such that a pressure differential between fluid in the internal chamber and filtered fluid within the staged filter is maintained within a predetermined operating pressure range.

6. The filtration device recited in claim 5 wherein the pressure management system comprises a first transducer arranged to measure pressure in the fluid in the internal chamber and second transducer arranged to measure pressure in the filtered fluid within the staged filter and a control system configured to receive pressure information from said first and second transducers and control the respective pressures such that said pressure differential is maintained within said predetermined operating pressure range.

7. The filtration device recited in claim 6 wherein said first and second transducers of the pressure management system comprise a means for detecting pressure.

8. The filtration device recited in claim 1 wherein the filter assembly comprises a first stage comprising a filter frame and associated filter membrane wherein the filter frame includes a top side and bottom side and wherein the frame is configured such that it can be mounted in the filtration device in both a top side up configuration or a bottom side up configuration.

9. The filtration device recited in claim 1 wherein the filter assembly comprises a filter assembly that can be subject to periodic indexed rotation such that the filter assembly can be partially rotated and secured at various intermittent intervals.

10. The filtration device recited in claim 1 wherein the filter assembly includes a race that extends around a circumference of the filter assembly;

the circulating cleaning assembly including a rigid bearing journaled around the race enabling rotation about the filter assembly such that the cleaning element moves at least one of across or near the filter membrane of the filter assembly when the circulating cleaning assembly is rotated about the filter assembly.

11. The filtration device recited in claim 10 wherein the rigid bearing includes a cutout portion arranged to enable particulate matter to be expelled from the bearing as the bearing is rotated about the filter assembly.

12. The filtration device as recited in claim 1 wherein the cleaning assembly includes a plurality of paddles positioned such that at least one of a fluid inlet stream and circulatory fluid motion within the fluid circulating region drives the rotation of the cleaning assembly.

13. The filtration device as recited in claim 12 wherein the plurality of paddles are positioned such that the paddles are angled away from the direction of the flow for at least one of the fluid inlet stream and the circulatory fluid within the fluid circulating region.

14. The filtration device as recited in claim 12 wherein the plurality of paddles are further supported by a support ring positioned such that the support ring radially supports the paddles.

15. The filtration device as recited in claim 12 wherein at least some of the paddles support a cleaning element at an operational distance from a cleaning membrane of the filter assembly.

* * * * *